US010336576B2

(12) United States Patent
Kattainen et al.

(10) Patent No.: US 10,336,576 B2
(45) Date of Patent: Jul. 2, 2019

(54) METHOD AND ELEVATOR

(71) Applicant: KONE Corporation, Helsinki (FI)

(72) Inventors: Ari Kattainen, Hyvinkää (FI); Juha-Matti Aitamurto, Hyvinkää (FI)

(73) Assignee: KONE CORPORATION, Helsinki (PL)

( * ) Notice: Subject to any disclaimer, the term of this patent is extended or adjusted under 35 U.S.C. 154(b) by 28 days.

(21) Appl. No.: 15/391,007

(22) Filed: Dec. 27, 2016

(65) Prior Publication Data

US 2017/0197804 A1 Jul. 13, 2017

(30) Foreign Application Priority Data

Jan. 13, 2016 (EP) ..... 16151048

(51) Int. Cl.

| | |
|---|---|
| ***B66B 5/00*** | (2006.01) |
| ***B66B 3/00*** | (2006.01) |
| ***B66B 1/30*** | (2006.01) |
| ***B66B 5/02*** | (2006.01) |
| *B66B 5/16* | (2006.01) |

(52) U.S. Cl.

CPC ..... *B66B 5/0031* (2013.01); *B66B 1/30* (2013.01); *B66B 3/002* (2013.01); *B66B 5/0025* (2013.01); *B66B 5/0037* (2013.01); *B66B 5/0093* (2013.01); *B66B 5/02* (2013.01); *B66B 2201/00* (2013.01)

(58) Field of Classification Search

CPC ..... B66B 5/0037; B66B 1/32; B66B 5/0006; B66B 5/16; B60T 17/22; B60T 7/085

See application file for complete search history.

(56) References Cited

U.S. PATENT DOCUMENTS

| | | | | |
|---|---|---|---|---|
| 4,887,695 A * | 12/1989 | Kindler | B66B 1/30 187/293 |
| 6,056,088 A * | 5/2000 | Gerstenkorn | B66B 5/0031 187/390 |
| 6,199,667 B1 * | 3/2001 | Fischgold | B66B 1/30 187/290 |

(Continued)

FOREIGN PATENT DOCUMENTS

| | | |
|---|---|---|
| CN | 105136509 A | 12/2015 |
| JP | 9-30750 A | 2/1997 |
| JP | 2005-1823 A | 1/2005 |

*Primary Examiner* — Marlon T Fletcher

(74) *Attorney, Agent, or Firm* — Birch, Stewart, Kolasch & Birch, LLP

(57) ABSTRACT

A method for testing operation of an elevator including an elevator car includes starting movement of the elevator car; and thereafter starting a stopping sequence for stopping movement of the elevator car; and monitoring movement of the elevator car, the monitoring preferably including monitoring acceleration of the elevator car; and detecting a predefined response in movement of the elevator car, the predefined response preferably being cease of acceleration of the elevator car; and determining time elapsed between the starting a stopping sequence and the detected predefined response in movement of the elevator car, wherein the response is preferably cease of acceleration, for thereby determining reaction time of the elevator; and comparing the time elapsed with at least one reference, such as with at least one predefined threshold. An elevator is provided for implementing the method.

20 Claims, 3 Drawing Sheets

(56) References Cited

U.S. PATENT DOCUMENTS

| | | | | |
|---|---|---|---|---|
| 6,202,796 | B1 * | 3/2001 | Lee | B66B 1/30 187/284 |
| 2011/0056771 | A1 * | 3/2011 | Ohya | B66B 1/30 187/296 |
| 2015/0014099 | A1 * | 1/2015 | Celik | B66B 1/24 187/275 |
| 2015/0259174 | A1 * | 9/2015 | Mustonen | B66B 5/0031 187/393 |

* cited by examiner

METHOD AND ELEVATOR

FIELD OF THE INVENTION

The invention relates to a method for testing operation of an elevator as well as to an elevator. Said elevator is particularly an elevator for transporting passengers and/or goods.

BACKGROUND OF THE INVENTION

Modern elevators are typically arranged to prohibit unintended car movement, i.e. non-commanded movement of the car with doors open within the door zone away from the landing.

This is implemented by providing the elevator with a means to stop the unintended car movement. These means may comprise a brake as well also an equipment activating the mechanical brake. Generally, the unintended car movement protection function (UCMP) can be divided into the following parts: detection equipment, activation equipment and stopping equipment. The detection equipment is configured for detecting occurrence of the unintended movement e.g. using a sensor, the activation equipment is configured for activating a stopping equipment, and the stopping equipment, such as a mechanical brake, is configured for executing the actual braking.

The function of the UCMP includes several actions occurring in a sequence. For swift and effective operation of the UCMP, it is important that the detection equipment appropriately swiftly triggers said activation, and said activation equipment appropriately swiftly activates the stopping equipment, and said stopping equipment appropriately swiftly performs braking of the car. It is possible that different failures or wear of the components, which cannot be detected by normal inspection or normal diagnostics in an inspection by a service person, can cause that the UCMP works too slowly and cannot stop the car within a desired distance. Such an effect can result from any delay formed in the operation of the system components at any point of the sequence. Such as delay can be formed in releasing of safety relays of the door zone, or releasing of main contactors or equivalent component used for activating the stopping equipment. Such an effect can result from failure of a DC-side circuit breaking component (e.g. relay) of the brake controller, for instance. Such an effect can also result from brakes becoming slower to drop. Accordingly, performance of the elevator braking system in emergency situations or other abnormal situations, and in particular the UCM situations, is not constant. In order to ensure safety, it would be advantageous to receive information describing state of these functions of an elevator. A drawback of the known elevators is that no information is received describing performance of the elevator braking system in said situations where swift braking is needed.

BRIEF DESCRIPTION OF THE INVENTION

The object of the invention is to introduce an improved method as well as an improved elevator, by which knowledge of prevailing state of the elevator can be increased. An object is particularly to introduce a solution by which braking performance of the elevator can be tested. With the solution, it is possible to test braking performance of the elevator such that the feedback received indicates essential characteristics of the prevailing performance of the braking system, taking into account delays contained in the braking process. The solution is particularly suitable for determining performance of the elevator braking system in emergency situations, particularly UCM situations or other abnormal situations where swift braking is needed.

It is brought forward a new method for testing operation of an elevator comprising an elevator car, the method comprising starting movement of the elevator car, in particular at a first moment; and thereafter starting a stopping sequence for stopping movement of the elevator car, in particular at a second moment; and monitoring movement of the elevator car, said monitoring preferably including monitoring acceleration and/or speed and/or velocity of the elevator car; and detecting a predefined response in movement of the elevator car, in particular occurring at a third moment, said predefined response preferably being cease of acceleration of the elevator car or start of decrease of the speed or velocity of the elevator car; and determining time elapsed between said starting a stopping sequence and the detected predefined response in movement of the elevator car, for thereby determining reaction time of the elevator; and comparing said time elapsed with at least one reference, such as with at least one predefined threshold. With this method, one or more of the above mentioned advantages and objectives are achieved. Particularly, monitoring the time needed to obtain a predefined response gives essential information about the performance of a large portion of the complete braking system. Furthermore, the method obtains information of the braking system in a form easily usable for comparison with references, and thereby also for trigging precautionary measures. Preferable further features are introduced in the following, which further features can be combined with the method individually or in any combination.

In a preferred embodiment, said response is cease of acceleration of the elevator car. This response is an important desired intermediate result in the process of a braking, and furthermore, it is simple to detect. Thereby, the time elapsed to reach this response describes condition of the complete braking system effectively, and provides a preferable basis for comparison with a reference.

In a preferred embodiment, said response is start of decrease of the speed or velocity of the elevator car. This response is an important desired intermediate result in the process of a braking correspondingly as said cease of acceleration, and furthermore, it is simple to detect. Thereby, the time elapsed to reach this response describes condition of the complete braking system effectively, and provides a preferable basis for comparison with a reference. This response provides one alternative response to be monitored.

In a preferred embodiment, said monitoring movement of the elevator car includes monitoring acceleration and/or speed and/or velocity of the elevator car. That is, any one, any two or all of these are monitored. Thus, data on car movement can be obtained, which is usable for detection of the predefined response. Data produced by monitoring any of these can be used for obtaining (e.g. by calculating) speed data, acceleration data or velocity data. Any of these can be chosen to be used for detecting the predefined response. Said monitoring can be continuous or intermittent, for example.

In a preferred embodiment, the method further comprises starting a timer at the same time the stopping sequence is started.

In a preferred embodiment, the elevator car is parked at a landing, in particular such that the landing sill and car sill are level with each other, at said moment, i.e. when said movement of the elevator car at said first moment is started.

In a preferred embodiment, said starting a stopping sequence is triggered when car reaches a predefined threshold position of the car. Preferably, said predefined threshold position of the car is a position of the car which is a distance d away in vertical direction from car position of the car where the car sill and the landing sill are level with each other, wherein said distance d is shorter than 1 meter, preferably within range of 0.02-0.35 meters. Preferably, said predefined threshold position of the car is defined by position of a position sensor. Preferably, in normal use of the elevator when car reaches said predefined threshold position (P2) of the car with its doors open a stopping sequence is automatically triggered.

In a preferred embodiment, the method further comprises monitoring car position. This preferably performed with a position sensing means, such as with at least one position sensor. Preferably, said starting a stopping sequence is triggered when the position sensing means for detecting car position detects that the car has reached the threshold position (P2). The position sensing means is preferably a contactless proximity sensor mounted in proximity of a landing. Alternatively, the position sensing means may comprise some other kind of sensor, such as a laser sensor, a magnetic strip sensor, ultrasonic sensor, an absolute encoder or an APS device e.g. utilizing one or more cameras.

In a preferred embodiment, the elevator performs the method automatically.

In a preferred embodiment, said stopping sequence includes activation of one or more mechanical brakes. Thus, the time lapsed will include any delay contained in the process of activation, making it usable for revealing any delay rendering the operation of the braking system dangerously slow. Preferably, said one or more mechanical brakes are brakes configured to act on a drive wheel around which one or more ropes connected with the car pass or a component fixed thereto when activated. Preferably, said activation of one or more brakes includes interrupting supply of electricity to electrically powered holding means holding brakes in a not braking state against a force generated by a spring mechanism In a preferred embodiment, the elevator comprises a motor for moving the car and said stopping sequence includes shifting the motor into non driving state, preferably by interrupting supply of electricity to the motor. Owing to shifting the motor into non driving state, the elevator car speed is brought down without control by the motor. This is the case in most emergency braking situations whereby the method suits well to simulate such situations.

In a preferred embodiment, said starting the stopping sequence includes breaking a safety chain of the elevator which has the consequence that the motor shifts into non driving state and brakes are activated, in particular supply of electricity to motor and brakes is cut In a preferred embodiment, the method further comprises triggering one or more predefined actions if said time elapsed exceeds at least one threshold. Said actions preferably include one or more of the following: preventing further starts of the elevator car; sending an alarm signal; sending a signal indicating that service is needed. A preferred threshold is a threshold time between 200-400 ms, preferably 300 ms. Said at least one threshold may of course comprise plurality of threshold, in which case when a first (lower) threshold is exceeded a first action is performed such as sending an alarm signal or sending a signal indicating that service is needed, and when a second (higher) threshold is exceeded a second action is performed such as preventing further starts of the elevator car.

In a preferred embodiment, the method for testing is performed only if the car is empty of passengers. Preferably, the method comprises at least before said stopping sequence is started ensuring the car is empty of passengers.

In a preferred embodiment, during said movement the doors are closed. Preferably, the method further comprises before said starting the movement, closing the car doors.

In a preferred embodiment, in said starting movement of the elevator car, movement of the elevator car is started in light direction, i.e. in a direction where the car is urged by unbalance between car and counterweight.

In a preferred embodiment, before said starting a stopping sequence the car is set to be driven with a constant speed not exceeding 1 m/s, preferably driven with a constant speed of 0.1-0.5 m/s, such as 0.3 m/s. Preferably, at said second moment, the car has a constant speed not exceeding 1 m/s, preferably 0.1-0.5 m/s, such as 0.3 m/s.

In a preferred embodiment, said determining time elapsed comprises measuring or calculating time elapsed between said starting of a stopping sequence and said detected predefined response in movement of the elevator car i.e. the time elapsed between the second moment and said third moment.

In a preferred embodiment, the method may additionally comprise determining distance traveled by the car between the first moment and a fourth moment, which fourth moment is the moment the elevator car reaches standstill, and the method comprises comparing said distance traveled by the car with at least one predefined threshold, and the method further comprises triggering one or more predefined actions if said distance traveled by the car 1 exceeds a threshold. Preferably, the threshold is a threshold distance within range of 0.5-1.2 meters, preferably at least 0.5 m and at most 1.0 meters. Preferably, said actions include one or more of the following: preventing further starts of the elevator car; sending an alarm signal; sending a signal indicating that service is needed.

In a preferred embodiment, said monitoring movement of the elevator car can comprise detecting movement of the elevator car by a detector. Said detecting movement can be performed using a detector which is an accelerometer, or alternatively a speed detector or velocity detector. Data produced by any of these detectors can be used for obtaining (e.g. by calculating) speed data, acceleration data or velocity data, whichever is chosen to be used for detecting the predefined response.

In a preferred embodiment, said detecting a predefined response comprises analyzing data obtained by said monitoring car movement In a preferred embodiment, said monitoring acceleration comprises producing momentary acceleration magnitude data to be used in said detecting.

In a preferred embodiment, in said movement started, the car is moved using the motor.

In a preferred embodiment, the breaking sequence brings the elevator car eventually to a standstill at a fourth moment.

It is also brought forward a new elevator comprising a hoistway, an elevator car moveable in the hoistway, an elevator control configured, for testing the elevator, to start movement of the elevator car, in particular at a first moment; and thereafter to start a stopping sequence for stopping movement of the elevator car, in particular at a second moment; and to monitor movement of the elevator car, said monitoring preferably including monitoring acceleration and/or speed and/or velocity of the elevator car; and to detect a predefined response in movement of the elevator car, in particular occurring at a third moment, said predefined response preferably being cease of acceleration of the elevator car or start of decrease of the speed or velocity of the elevator car; and to determine time elapsed between said starting a stopping sequence and the detected predefined response in movement of the elevator car, for thereby determining reaction time of the elevator; and to compare said time elapsed with at least one reference, such as with at least one predefined threshold. Thus the one or more of the above mentioned advantages and objectives are achieved, as above described in context of the method.

In a preferred embodiment, the elevator is configured to perform the method for testing the elevator, in particular the steps thereof, which method has been described above or elsewhere in the application.

In a preferred embodiment, the elevator is configured to perform the steps for testing the elevator automatically. Preferably, the elevator is configured to perform the steps for testing the elevator automatically periodically (daily, or if period from last test exceeds a threshold) or automatically in response to a remote command e.g. from service center or automatically in response to a manual command from a service person e.g. via an elevator control panel comprised in the elevator control.

The elevator is preferably such that the car thereof is arranged to serve two or more landings. The elevator preferably controls movement of the car in response to signals from user interfaces located at landing(s) and/or inside the car so as to serve persons on the landing(s) and/or inside the elevator car. Preferably, the car has an interior space suitable for receiving a passenger or passengers, and the car is provided with one or more doors movable between open and closed state.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
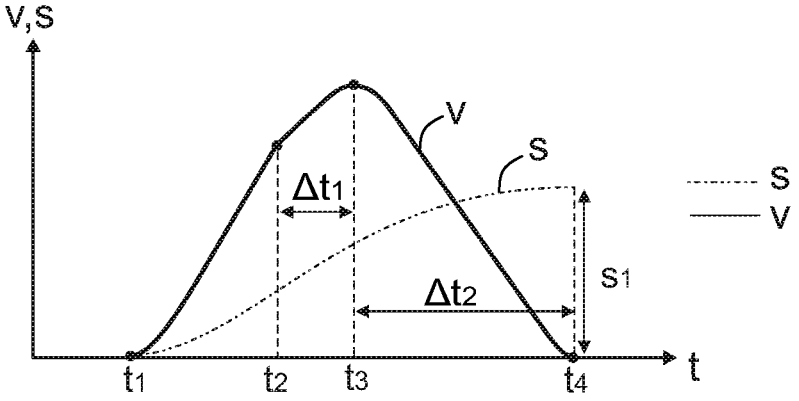
FIG. 1 illustrates a velocity curve of an elevator car realized in a method for testing operation of an elevator in accordance with a first embodiment of the invention as well as a distance curve indicated distance traveled.
Figure 2:
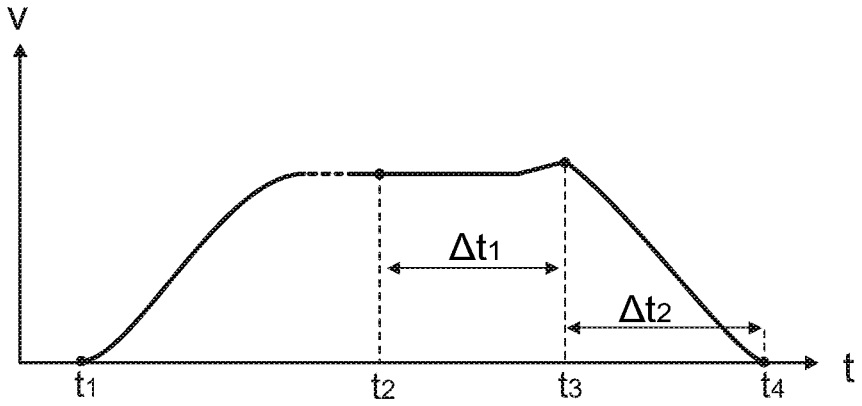
FIG. 2 illustrates a velocity curve of an elevator car realized in a method for testing operation of an elevator in accordance with a second embodiment of the invention.
Figure 3:
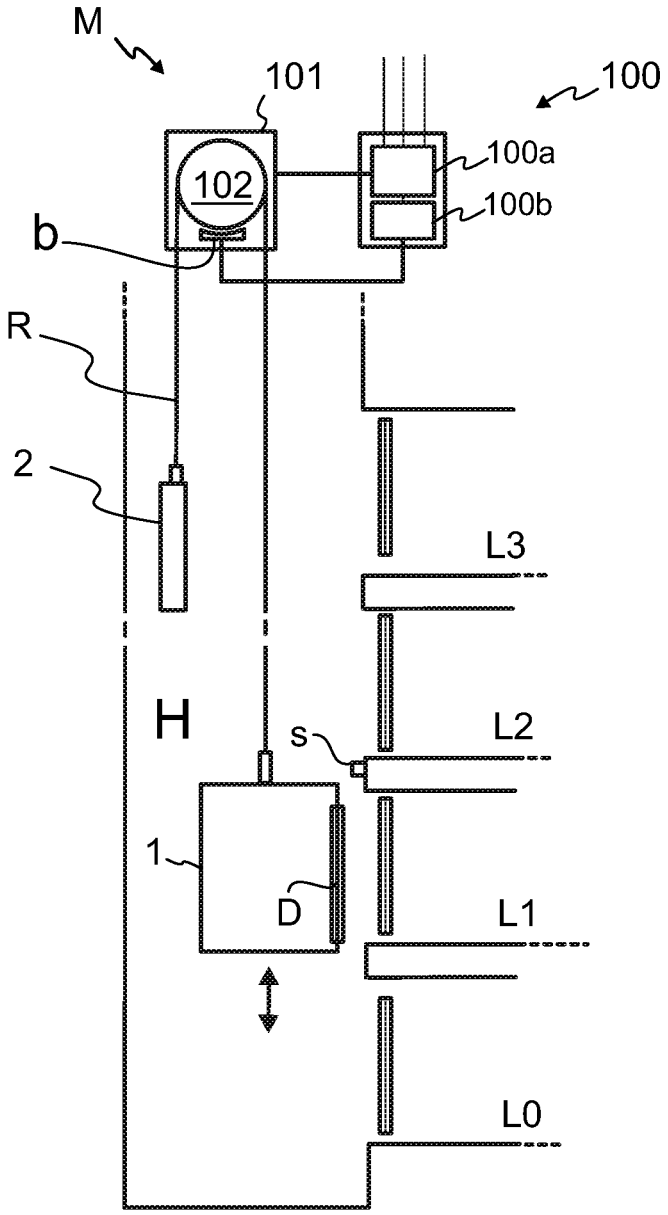
FIG. 3 illustrates an elevator in accordance with an embodiment of the invention.

FIGS. 1 and 2 illustrate each a velocity curve of an elevator car of an elevator. The velocity curve presented in FIG. 1 is an exemplary velocity curve produced by carrying out a method for testing operation of an elevator in accordance with a first embodiment of the invention, whereas the velocity curve presented in FIG. 2 is an exemplary velocity curve produced by carrying out a method for testing operation of an elevator in accordance with a second embodiment of the invention. In each case, the elevator comprises an elevator car, hereinafter referred to as elevator car 1, which is suitable for receiving passengers and/or goods and vertically movable in a hoistway H between two or more landings L0-L3. One possible configuration for the elevator structure implementing the method is illustrated in FIG. 3.

Referring to FIGS. 1 and 2, in the method for testing operation of an elevator, movement of the elevator car 1 is started at a first moment t1. Thereafter a stopping sequence for stopping movement of the elevator car 1 is started at a second moment t2. As visible in the FIGS. 1 and 2, no immediate effect can be noticed in velocity of the car 1 at moment t2, when the stopping sequence is started, which is due to the fact that the stopping sequence takes some time to take effect. In addition to the necessary delays, some unnecessary delays formed in the operation of the system components at any point of the sequence may emerge during long term use of the elevator, and reaction time extends beyond acceptable. In the method, movement of the elevator car, preferably acceleration, is monitored during movement of the car 1. Additionally or alternatively, speed and/or velocity of the elevator car 1 is monitored. Data produced by monitoring any of these can be used for obtaining (e.g. by calculating) the parameter chosen to be used in detection of a predefined response to the stopping sequence started. The braking will eventually take effect, and in the method a predefined response in movement of the elevator car is detected to occur at a third moment t3. Said response is a response to said starting the stopping sequence, most preferably being cease of acceleration (i.e. that acceleration has decreased to zero). In the method, time $\Delta t_1$ elapsed between said starting of a stopping sequence and said detected predefined response in movement of the elevator car 1 is determined for thereby determining reaction time of the elevator. As mentioned, said response is preferably cease of acceleration of the elevator car. As visible in FIGS. 2 and 3, said time $\Delta t_1$ elapsed is the time elapsed between the second moment t2 and the third moment t3. In the method, said time elapsed $\Delta t_1$ is compared with one or more references, such as with one or more predefined thresholds. The predefined threshold can be a predefined threshold time stored in a memory of the elevator.

By comparison of the time $\Delta t_1$ elapsed with a reference, it is possible to test if the elevator being tested has sufficiently short reaction time, and in particular to receive information suitable for determination if one or more predefined thresholds is exceeded. Such thresholds may, for instance, comprise a threshold exceeding of which means the elevator needs servicing and/or a threshold exceeding of which means the elevator is in condition requiring immediate prohibition of further use, i.e. preventing further starts. The door zone typically being provided with redundancy, the focus of the testing can be in the functions related to activation and stopping.

As mentioned, said response is most preferably cease of acceleration. An elevator behaves such that at some moment between t2 and t3 the braking starts to affect car movement. However, in the method, that moment need not be given primary attention. That moment is difficult to determine, and it does not reflect complete performance of the braking sequence. Instead, attention is most preferably focused on the time $\Delta t_1$ (reaction time) needed to achieve such an effect that the acceleration ceases. This response is an important desired intermediate result in the process of a braking, and furthermore it is simple to detect. Thereby, the time elapsed to reach this response describes condition of the complete braking system effectively, and provides a preferable basis for comparison with a reference. As an alternative to the response being cease of acceleration, said response can be start of decrease of the speed or velocity of the elevator car.

This response is an important desired intermediate result in the process of a braking correspondingly as said cease of acceleration.

Said determining time $\Delta t_1$ elapsed can be implemented in one of various alternative ways. Most preferably, the method further comprises starting a timer at the same time the stopping sequence is started, i.e. at the second moment t2. The timer is then utilized in said determining the time $\Delta t_1$ elapsed. A timer is a simple way to determine the time elapsed by measuring. The time elapsed can thus be determined by noting the time indicated by the timer at the third moment t3. Alternatively, the time of a clock is noted at the second moment t2 as well as at the third moment t3 and the time elapsed is determined by calculation. Said determining the time $\Delta t_1$ elapsed can be performed by utilizing one or more processors, such as one or more microprocessors comprised in the elevator.

Figure 4:
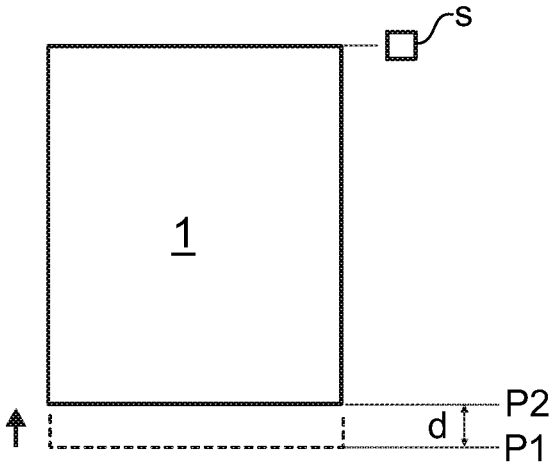
FIG. 4 illustrates a predefined threshold position defined for the car in a preferred embodiment.

Preferably, said starting a stopping sequence is triggered when car reaches a predefined threshold position P2 of the car. The threshold position P2 is illustrated in FIG. 4. Said predefined threshold position P2 of the car is a position of the car which is a distance d in vertical direction away from car position P1 of the car 1, and when the car 1 is in position P1 the car sill and the landing sill are level with each other. As a result, so as to be in the threshold position P2 of the car, the car 1 needs to travel the distance d away from the position P1. Said distance d is preferably within range of 0.02-1.00 meters. When said distance is short the method suits well to simulate unintended car movement situation as well as to utilize sensor s used for UCMP function. More preferably, said distance d is within range of said 0.02-0.35 meters. With this position P2 the method is well focused on testing performance of UCMP function of the elevator. The elevator is such that in normal use of the elevator the stopping sequence is automatically triggered when car reaches the predefined threshold position P2 of the car with its doors D open.

Preferably, the method further comprises monitoring car position with at least one position sensor s. In this case, in the method, said starting a stopping sequence is triggered when a position sensing means, such as a position sensor s for detecting car position detects that the car has reached the threshold position P2. Thus, said predefined threshold position P2 of the car is defined by position of the sensor s. The position sensor s is most preferably here a contactless proximity sensor mounted in proximity of a landing L1.

Said stopping sequence is preferably such that it includes activation of one or more mechanical brakes b, wherein said activation means trigging the one or more mechanical brakes to shift into a braking state. This is preferably implemented such that said activation of one or more brakes includes interrupting supply of electricity to electrically powered holding means which hold said one or more brakes in a not braking state against a force generated by a spring mechanism when electrically powered. Said one or more mechanical brakes b are preferably brakes configured to act on a drive wheel 102 or a component fixed thereto when activated, around which drive wheel 102 one or more ropes R connected with the car 1 pass. Said activation may be performed by control unit 100*b* controlling the supply of electricity to the brakes b, for instance.

The elevator preferably comprises a drive machinery M comprising a motor 101 for moving the car 1. It is preferable, that in said movement started, the car 1 is moved using the motor 101. In addition to activation of one or more mechanical brakes b said stopping sequence preferably also includes shifting the motor 101 into non driving state, which can be done by interrupting supply of electricity to the motor 101.

Preferably, the method further comprises triggering one or more predefined actions if said time elapsed $\Delta t_1$ exceeds at least one predefined threshold. Preferably, said threshold is a threshold time between 200-400 ms, preferably 300 ms. Preferably, said actions include one or more of the following: preventing further starts of the elevator car; sending an alarm signal; sending a signal indicating that service is needed. Said at least one threshold may comprise plurality of thresholds, and when a first (lower) threshold is exceeded a first action is performed such as sending an alarm signal or sending a signal indicating that service is needed, and when a second (higher) threshold is exceeded a second action is performed such as preventing further starts of the elevator car.

So as to make the method safe, it is preferable that the method further comprises before said starting the movement, closing the car door(s) D. Thereby, during said movement the doors D of the car 1 are closed. Likewise, it is preferable that the method for testing is performed only if the car 1 is empty of passengers. For this end, the method preferably comprises at least before starting said stopping sequence a step of ensuring that the car 1 is empty of passengers.

So as to make the test result reliable, it is preferable the running direction is chosen such that the worst case is tested. Thus, it is preferable that in said starting movement of the elevator car, movement of the elevator car is started in light direction, i.e. in a direction where the car 1 would be moved as a result of gravity affecting the car and components connected thereto, such as any ropings R and/or counterweights 2 connected thereto. In the case of a counterweighted elevator said light direction is preferably upwards and in the case of counterweightless elevator said light direction is preferably downwards.

Although not necessary, it is preferable in both embodiments that the elevator car is parked at a landing, in particular such that the landing sill and car sill are level with each other, at said moment t1, i.e. when said movement of the elevator car at said first moment t1 is started. Hereby, safety of the method can be more easily ensured, in particular that the car is empty of passengers.

In the first embodiment presented in FIG. 1, the testing is implemented in close to similar fashion as unintended car movement situations most often occurs in practice. In context of the first embodiment illustrated in FIG. 1, it is especially advantageous that the elevator car 1 is parked in position P1 at a landing at said moment t1 when said movement of the elevator car 1 is started, whereby the landing sill and car sill are level with each other. Furthermore, it is preferable that said starting a stopping sequence is performed when car reaches a predefined threshold position P2 of the car, which predefined threshold position P2 of the car is a position of the car between 0.02 and 1.00 meters, preferably between 0.02 and 0.35 meters, in vertical direction away from said car position P1 of the car where the car was parked at the first moment t1 such that the car sill and the landing sill were level with each other. This is advantageous because in this way the method imitates the unintended car movement situation almost one to one. Performing the method also takes only little time.

FIG. 1 illustrates also a distance curve indicating distance traveled by the car 1 when carrying out the method. The method according to the first embodiment may additionally comprise determining distance s1 traveled by the car 1 between the first moment t1 and a fourth moment t4, which fourth moment is the moment the elevator car 1 reaches standstill, and the method comprises comparing said distance traveled by the car 1 with at least one predefined threshold, and the method further comprises triggering one or more predefined actions if said distance traveled by the car 1 exceeds a threshold. The threshold is preferably a threshold distance between 0.5-1.2 meters, preferably at least 0.5 m and at most 1.0 meters. Said actions preferably include one or more of the following: preventing further starts of the elevator car; sending an alarm signal; sending a signal indicating that service is needed. Distance s1 indicates in how short a distance the car leaving from a landing can reach a standstill. So as to ensure safety of the elevator, this distance needs to be kept below a predefined threshold chosen based on safety issues. Being able for determining and comparison of this distance s1, the method suits well for testing this safety aspect, as well.

In the second embodiment presented in FIG. 2, before said starting a stopping sequence, the car is set to be driven with a constant speed not exceeding 1 m/s, preferably driven with a constant speed of 0.1-0.5 m/s, such as 0.3 m/s. It follows that at said second moment t2, the car has a constant speed not exceeding 1 m/s, preferably said 0.1-0.5 m/s, such as 0.3 m/s. In this embodiment, the car position where the stopping sequence is started can be more flexibly chosen.

FIG. 3 illustrates a preferred embodiment of an elevator according to the invention. The elevator implements the method described elsewhere in the application. The elevator comprises a hoistway H, an elevator car 1 moveable in the hoistway H, and an elevator control 100, which is configured to perform at least the following steps for testing the elevator to start movement of the elevator car 1 at a first moment t1; and thereafter to start a stopping sequence for stopping movement of the elevator car 1, at a second moment t2; and to monitor movement of the elevator car. Said monitoring preferably includes monitoring acceleration and/or speed and/or velocity of the elevator car 1. The elevator control 100 is further configured to detect a predefined response in movement of the elevator car 1 occurring at a third moment t3, said predefined response preferably being cease of acceleration of the elevator car (i.e. acceleration has decreased to zero) or alternatively start of decrease of the speed or velocity of the elevator car 1, and to determine time $\Delta t_1$ elapsed between said starting a stopping sequence and said detected predefined response in movement of the elevator car 1, for thereby determining reaction time of the elevator; and to compare said time elapsed $\Delta t_1$ with at least one reference, such as with at least one predefined threshold. As already described above, said response is most preferably cease of acceleration of the elevator car 1. The elevator is preferably further configured to trigger one or more predefined actions if said time elapsed $\Delta t_1$ exceeds at least one threshold.

Preferably, the elevator is configured to perform the steps for testing the elevator automatically. The elevator can be configured to perform the steps for testing the elevator automatically periodically (daily, or if period from last test exceeds a threshold) or automatically in response to a remote command e.g. from service center or automatically in response to a manual command from a service person e.g. via an elevator control panel comprised in the elevator control.

The elevator comprises a drive machinery M comprising a motor 101 for moving the car 1. The elevator comprises one or more mechanical brakes b configured to act on a drive wheel 102 or a component fixed thereto when activated, around which drive wheel 102 one or more ropes R connected with the car 1 pass. Said activation may be performed by control unit 100*b* comprised in the elevator control 100, for instance. Said stopping sequence is preferably such that it includes activation of one or more mechanical brakes b, wherein said activation means trigging the one or more mechanical brakes to shift into a braking state. This is preferably implemented such that said activation of one or more brakes includes interrupting supply of electricity to electrically powered holding means which hold said one or more brakes in a not braking state against a force generated by a spring mechanism when electrically powered. In addition to activation of one or more mechanical brakes b said stopping sequence preferably also includes shifting the motor 101 into non driving state, which can be done by interrupting supply of electricity to the motor 101. Supply of electricity to the motor 101 is controlled preferably by an electric drive system such as a frequency controller 100*a* illustrated in FIG. 3. Said interrupting supply of electricity to electrically powered holding means and/or interrupting supply of electricity to the motor 101 could be alternatively performed by a safety controller cutting a safety chain of the elevator, a well-known safety means of an elevator, which has the effect that supply of electricity to motor and brakes is cut.

Generally, the starting sequence typically causes the moment of motor to drop earlier than brakes are dropped, which has the effect that the velocity may at first increase. This is clearly visible in FIG. 2. The same effect can occur in the first embodiment, however it is not as easily detectable due to the fact that in the second embodiment the stopping sequence is started during a constant velocity situation.

It is preferable, that in the method the braking sequence is let to bring the elevator car 1 eventually to a standstill at moment t4. This is however not necessary, because alternatively the braking sequence can be interrupted as soon as the necessary information has been obtained, i.e. at least the predefined response for the stopping sequence has been detected.

The method may additionally comprise determining time ($\Delta t_2$=t4−t3) elapsed between the third moment t3 and a fourth moment t4, which fourth moment is the moment the elevator car 1 reaches standstill. Likewise, the method may additionally comprise determining deceleration between the third moment t3 and the fourth moment t4. One or more threshold can be assigned for these parameters as well.

The steps of the method can be implemented in various different ways. In one way of implementation, the step of said monitoring movement of the elevator car can be implemented using at least a detector detecting movement of the elevator car. Monitoring particularly the acceleration can be performed in numerous alternative ways, e.g. directly or indirectly. Said monitoring acceleration of the elevator car 1 can, for instance, comprise detecting acceleration by a detector, e.g. by accelerometer, or alternatively detecting speed or velocity of the elevator car by a detector and thereafter determining (e.g. by calculating) acceleration based on changes of speed or velocity. In addition, one or more processor, such as one or more microprocessors, can be used to execute said monitoring movement of the elevator car. In one way of implementation of the step of said detecting a predefined response, this step comprises analyzing data obtained by said monitoring car movement. Preferably, said monitoring acceleration comprises producing momentary acceleration magnitude data to be used in said detecting. Determining the third moment t3, on the other hand, can be performed based on said analyzing.

The at least one threshold for said time elapsed $\Delta t_1$ is preferably stored in a memory, such as a hardrive or a memory chip, and said comparing is performed using one or more processors, such as microprocessors, connected with said memory.

As mentioned, in the most preferred embodiment, said predefined response in movement of the elevator car 1, wherein said response is a response to starting the stopping sequence, is cease of acceleration of the elevator car 1, or alternatively start of decrease of the speed or velocity of the elevator car 1. More broadly considered, however, said response can be any predetermined change in one or more of the following: acceleration of the elevator car 1, speed of the elevator car 1, velocity of the elevator car 1. Thus, the reaction time of the elevator to reach any desired response in movement of the elevator car can be determined.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A method for testing operation of an elevator, the elevator comprising an elevator car, the method comprising the steps of:

starting movement of the elevator car; and thereafter starting a stopping sequence for stopping movement of the elevator car; and monitoring movement of the elevator car; and detecting a predefined response in movement of the elevator car; and determining a time (Δt1) elapsed between said step of starting a stopping sequence and the detected predefined response in movement of the elevator car, for thereby determining a reaction time of the elevator; and comparing said time elapsed (Δt1) with at least one reference, wherein said step of starting a stopping sequence is an activation of one or more brakes, and the predefined response is cease of acceleration or start of decrease of the speed.

2. The method according to claim 1, wherein said response is cease of acceleration of the elevator car.

3. The method according to claim 1, wherein said response is start of decrease of the speed or velocity of the elevator car.

4. The method according to claim 1, wherein said monitoring movement of the elevator car includes monitoring acceleration and/or speed and/or velocity of the elevator car.

5. The method according to claim 1, wherein the elevator car is parked at a landing, such that the landing sill and car sill are level with each other, when said movement of the elevator car is started.

6. The method according to claim 1, wherein said starting a stopping sequence is triggered when the elevator car reaches a predefined threshold position of the car, said predefined threshold position of the car being a position of the elevator car which is a distance away in a vertical direction from a position of the car where the car sill and the landing sill are level with each other, wherein said distance is at most 1.00 meter.

7. The method according to claim 1, wherein said stopping sequence includes activation of one or more mechanical brakes.

8. The method according to claim 1, wherein the elevator comprises a motor for moving the elevator car and said stopping sequence includes shifting the motor into a non driving state by interrupting supply of electricity to the motor for thereby shifting the motor into non driving state.

9. The method according to claim 1, wherein the method further comprises triggering one or more predefined actions if said time elapsed (Δt1) exceeds at least one threshold, said actions including one or more of the following: preventing further starts of the elevator car; sending an alarm signal; sending a signal indicating that service is needed.

10. The method according to claim 1, wherein the method comprises, at least before said stopping sequence is started, ensuring the elevator car is empty of passengers.

11. The method according to claim 1, wherein during said movement, the doors of the elevator car are closed.

12. The method according to claim 1, wherein before said starting, a stopping sequence the elevator car is set to be driven with a constant speed not exceeding 1 m/s.

13. The method according to claim 1, wherein said determining time (Δt1) elapsed comprises measuring and/or calculating time elapsed between said starting of a stopping sequence and said detected predefined response in movement of the elevator car.

14. The method according to claim 1, wherein the method additionally comprises determining a distance traveled by the car between the first moment and a fourth moment, which fourth moment is the moment the elevator car reaches standstill, and the method comprises comparing said distance traveled by the car with at least one predefined threshold, and the method further comprises triggering one or more predefined actions, if said distance traveled by the car exceeds at least one threshold.

15. An elevator comprising a hoistway, an elevator car moveable in the hoistway, and an elevator control, said elevator control being configured to perform the method defined in claim 1 for testing the elevator.

16. The method according to claim 2, wherein in said step of comparing, said time elapsed (Δt1) is compared with at least one predefined threshold.

17. An elevator comprising a hoistway, an elevator car moveable in the hoistway, and an elevator control, said elevator control being configured:

to start movement of the elevator car; and thereafter to start a stopping sequence for stopping movement of the elevator car; and to monitor movement of the elevator car; and to detect a predefined response in movement of the elevator car; and to determine a time (Δt1) elapsed between said starting a stopping sequence and the detected predefined response in movement of the elevator car for thereby determining reaction time of the elevator; and to compare said time elapsed (Δt1) with at least one reference, wherein said starting a stopping sequence is an activation of one or more brakes, and the predefined response is cease of acceleration or start of decrease of the speed.

18. The elevator according to claim 17, wherein the elevator is configured to perform the steps for testing the elevator automatically.

19. The elevator according to claim 17, wherein in said step of comparing, said time elapsed (Δt1) is compared with at least one predefined threshold.

20. A method for testing operation of an elevator, the elevator comprising an elevator car, the method comprising the steps of:

starting movement of the elevator car; and thereafter starting a stopping sequence for stopping movement of the elevator car; and monitoring movement of the elevator car; and detecting a predefined response in movement of the elevator car; and determining a time ($\Delta t1$) elapsed between said step of starting a stopping sequence and the detected predefined response in movement of the elevator car, for thereby determining a reaction time of the elevator; and comparing said time elapsed ($\Delta t1$) with at least one reference, wherein said starting a stopping sequence is triggered when the elevator car reaches a predefined threshold position of the car, said predefined threshold position of the car being a position of the elevator car which is a distance away in a vertical direction from a position of the car where the car sill and the landing sill are level with each other, wherein said distance is at most 1.00 meter.

* * * * *